US008584610B1

(12) United States Patent
Townsend

(10) Patent No.: US 8,584,610 B1
(45) Date of Patent: Nov. 19, 2013

(54) SPRING LOADED GEARED FLAP RUDDER

(71) Applicant: Corning Townsend, Edgecomb, ME (US)

(72) Inventor: Corning Townsend, Edgecomb, ME (US)

( * ) Notice: Subject to any disclaimer, the term of this patent is extended or adjusted under 35 U.S.C. 154(b) by 0 days.

(21) Appl. No.: 13/789,398

(22) Filed: Mar. 7, 2013

(51) Int. Cl.
*B63H 25/06* (2006.01)

(52) U.S. Cl.
USPC ..... 114/162

(58) Field of Classification Search
USPC ..... 114/162–172
See application file for complete search history.

(56) References Cited

U.S. PATENT DOCUMENTS

| | | | | |
|---|---|---|---|---|
| 715,178 | A | 12/1902 | Swan | |
| 1,582,391 | A | 4/1926 | Flettner | |
| 1,661,114 | A | 2/1928 | Flettner | |
| 2,178,555 | A | 11/1939 | Briggs | |
| 2,277,378 | A | 3/1942 | Wells | |
| 2,597,189 | A | 5/1952 | Sands | |
| 2,726,621 | A | 12/1955 | Hill | |
| 3,101,693 | A | 8/1963 | Schilling | |
| 3,606,852 | A | 9/1971 | Cafiero | |
| 4,434,739 | A * | 3/1984 | Brix et al. | 114/162 |
| 4,510,880 | A | 4/1985 | Kuribayashi | |
| 4,563,970 | A | 1/1986 | Walker | |
| 4,683,830 | A | 8/1987 | Corlett | |
| 6,032,602 | A | 3/2000 | Ehluss et al. | |
| 7,487,934 | B2 | 2/2009 | Johnsson | |
| 7,591,230 | B2 | 9/2009 | Kluge et al. | |
| 8,282,038 | B2 | 10/2012 | MacGregor et al. | |
| 2010/0251951 | A1 | 10/2010 | Kuhlmann | |
| 2010/0269745 | A1 | 10/2010 | Kuhlmann | |

FOREIGN PATENT DOCUMENTS

| | | | | |
|---|---|---|---|---|
| DE | 7829008 | | 9/1978 | |
| EP | 51822 | A1 | 5/1982 | |
| EP | 0247273 | | 2/1987 | |
| EP | 1446322 | | 12/2005 | |
| EP | 2006201 | | 11/2009 | |
| FR | 1382764 | | 2/1964 | |
| GB | 550713 | | 1/1943 | |
| GB | 2248049 | | 3/1992 | |
| JP | 57-060971 | | 4/1982 | |
| JP | 58-164498 | | 9/1983 | |
| JP | 58164498 | A * | 9/1983 | B63H 25/38 |
| JP | 59-199396 | | 11/1984 | |
| JP | 61-150898 | | 9/1986 | |
| JP | 62-71098 | | 6/1987 | |
| JP | 62-181999 | | 10/1987 | |
| JP | 63-215496 | | 7/1988 | |
| JP | 50-27359 | | 7/1993 | |
| JP | 50-64099 | | 8/1993 | |
| JP | 08-230790 | | 9/1996 | |
| KR | 2012097234 | A * | 9/2012 | B36H 25/38 |

OTHER PUBLICATIONS

Statement regarding the availability of translations for certain of the foreign patent references, Aug. 30, 2013, 2 pp.

* cited by examiner

*Primary Examiner* — Daniel Venne
(74) *Attorney, Agent, or Firm* — Verrill Dana, LLP; Chris A. Caseiro

(57) ABSTRACT

A spring-loaded flap rudder adapted to be mounted to the hull structure of a ship. In a geared version of the invention, the rudder includes a rudder member and a rudder gear including rudder teeth. The rudder also includes a flap member pivotally connected to the rudder member with a spring and a movable flap gear. The flap gear includes a rod movably engaged in a socket of the flap member and gear teeth for engagement with the rudder teeth of the rudder gear.

5 Claims, 2 Drawing Sheets

SPRING LOADED GEARED FLAP RUDDER

BACKGROUND OF INVENTION

1. Field of the Invention

The present invention relates to marine craft. More particularly, the present invention relates to the rudders of marine craft. Still more particularly, the present invention relates to flap rudders.

2. Description of the Prior Art

A rudder in the form of a pivotable plate or a displacement body is disposed at the stern of a ship. When the rudder is actuated, it is pivoted by a controlled angle of deflection. That movement develops a hydrodynamic transverse force which acts on the rudder and correspondingly on the stern of the ship. This force produces the turning torque required to steer the ship. This hydrodynamic transverse force produces a torque on the rudder with respect to the rudder stock which is to be supplied by the steering gear.

There are single member rudders, flap rudders and geared flap rudders. The current basic arrangement for a geared flap rudder includes a rudder member with an associated fixed gear that engages with a flap member having an associated movable gear. The rudder member is oriented forward of the flap member when viewing the vessel bow to stern. The forward gear of the rudder member is joined to the hull and the aft gear of the flap member is joined to the flap member. As the rudder stock is turned, the flap angle is double the rudder angle. There are no sliding parts, no energy absorber and no bearings other than on the flap member to the rudder member. In another design, the rudder member includes a positively controlled fin that is deflected in opposition to the main rudder deflection without the aid of powered steering gear in order to establish torque equilibrium with respect to the rudder stock.

A limitation of the existing geared flap rudder design is experienced when the rudder member or the flap member is bent, such as may occur when either contacts large debris. If the bend is significant enough, it is not possible to move either or both of the rudder member and the flap member as desired to change their respective positions. That circumstance will compromise ship maneuverability. Another limitation of the existing geared flap rudder design occurs when debris, such as a log for example, wedges into the gearing, rendering it difficult or impossible to change the position of the gear. That too, will compromise the ability to maneuver the ship.

What is needed is a geared flap rudder that is configured to minimize the operation of the rudder when either or both of the rudder and the flap are impacted and bent. What is also needed is a geared flap rudder that is configured to avoid gear lockup resulting from debris getting into the gears that exist on the flap and the rudder. The geared flap rudder should remain functional for normal operations whether or not the flap, the rudder or the gears are compromised.

SUMMARY OF THE INVENTION

It is an object of the present invention to provide a spring-loaded flap rudder that is configured to minimize the operation of the rudder when either or both of the rudder and the flap are impacted and bent. It is also an object of the present invention to provide a spring-loaded geared flap rudder that is configured to avoid gear lockup resulting from debris getting into the gears that exist on the flap and the rudder. The geared flap rudder of the present invention remains functional for normal operations whether or not the flap, the rudder or the gears are compromised.

These and other objects are achieved with the present invention, which is a spring-loaded geared flap rudder. There is no other flap rudder available that is spring-loaded. The spring-loaded geared flap rudder of the present invention is substantially advantageous over any existing flap rudder. The spring is adjustable and so can be used to account for any misalignment of components of the flap rudder, including the gears of a geared flap rudder. That makes the present invention less costly to produce in addition to being less prone to jamming and deflections. Existing rudders must be manufactured and put together with tighter tolerances than is necessary with a spring-loaded flap rudder so that any problems of misalignment can be minimized.

The rudder joins the aft gear to a rod which fits into a cylinder and that cylinder is joined to the flap. At the aft end of the cylinder there is a spring. If the rudder stock is bent forward or aft, the spring deflects in or out to prevent jamming. If the rudder stock is bent to the side, the rod rotates in the cylinder and prevents jamming. This interface joins the flap and the moving gear together. The thickness of the gears can be made sufficient so that any relatively small branch, for example, that gets in the gear will be pulverized by the gear movement and any larger log will not fit between the gear teeth. The interface includes a cover plate that protects against items entering the gearing from above. The effective arm of the flap is constant, so that there is just as much force keeping the flap extended at 45 degrees as there is keeping it from wobbling at 0 degrees.

The invention is a spring-loaded rudder adapted to be mounted to the hull structure of a ship, the rudder comprising a rudder member including a rudder stock rotatably connectable to the hull structure, a rudder gear connectable to the hull structure, the rudder gear including rudder teeth, a flap member pivotally connected to the rudder member, wherein the flap member includes a socket and a flap gear including a rod movably engaged in the socket of the flap member and gear teeth for engagement with the rudder teeth of the rudder gear. The rudder includes a gear cover connectable to the hull structure and the rudder gear to cover the rudder teeth and the gear teeth. The rod of the flap gear is arranged for rotational and axial movement. The flap gear includes a spring positioned in the socket and arranged to enable axial movement of the rod of the flap gear. The flap member is pivotally connected to a trailing edge of the rudder member. The invention is, more generally, a spring-loaded flap rudder, whether or not the flap and rudder members include gears.

The introduction of the spring element within the cylinder at the flap gear to rudder gear interface ensures that the rudder remains operational when either is bent and when debris wedges into the gearing. This makes operation of the ship more certain and safer than is the case when existing geared flap rudders are used. These and other features and advantages of the present invention will be understood upon review of the following detailed description, the accompanying drawings and the appended claims.

DETAILED DESCRIPTION OF THE INVENTION

Figure 1:
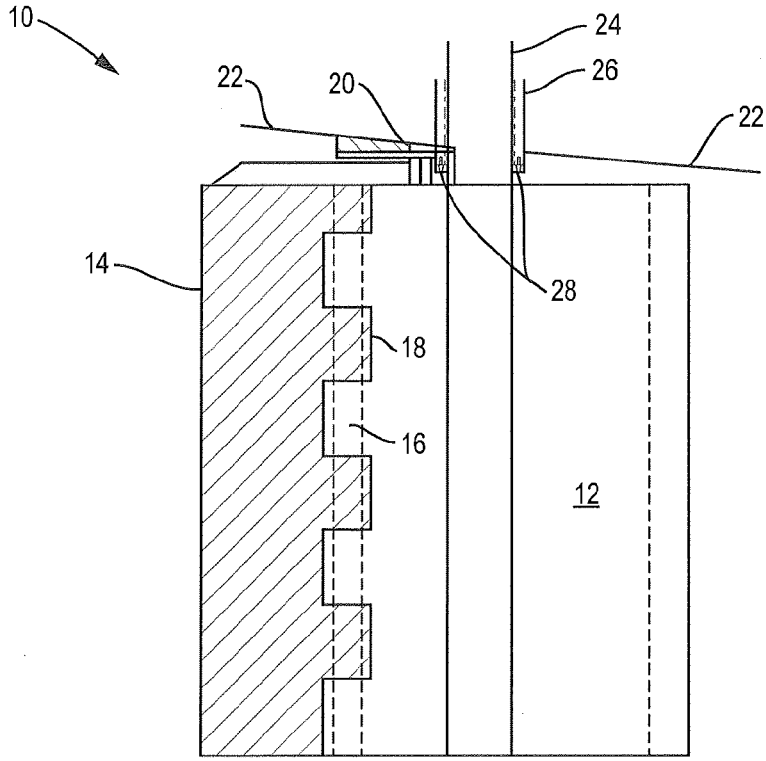
FIG. 1 is a side view of the spring-loaded geared flap rudder of the present invention.
Figure 2:
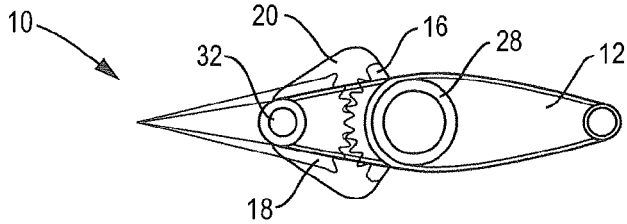
FIG. 2 is a top view of the rudder of the present invention with the rudder and flap aligned.
Figure 3:
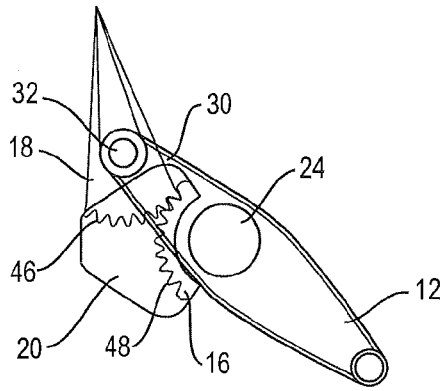
FIG. 3 is a top view of the rudder of the present invention with the rudder and flap angled with respect to a centerline.
Figure 4:
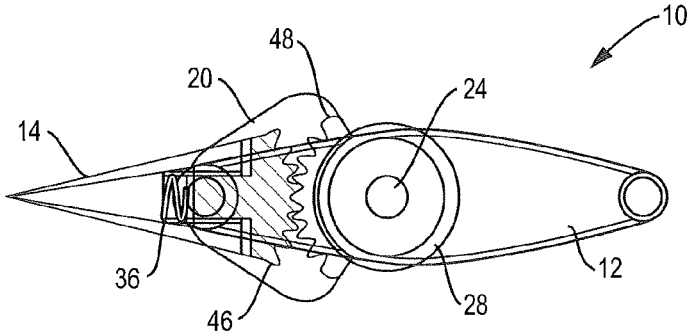
FIG. 4 is a top cross-sectional view of the rudder of the present invention.
Figure 5:
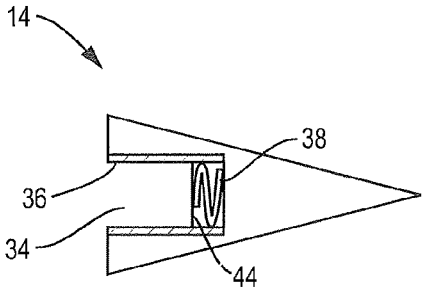
FIG. 5 is a top view of the flap member of the rudder of the present invention.
Figure 6:
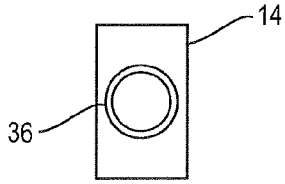
FIG. 6 is an end view of the flap member.
Figure 7:
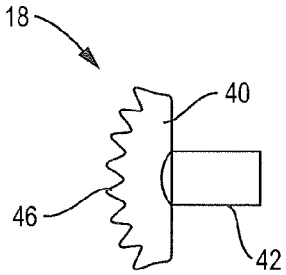
FIG. 7 is a top view of the flap gear showing the rod portion that inserts into the socket of the flap member.
Figure 8:
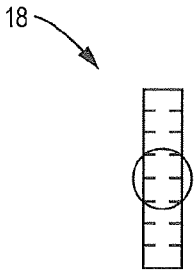
FIG. 8 is an end view of the rod.

A spring-loaded geared flap rudder 10 of the present invention is shown in FIGS. 1-4. The flap rudder 10 includes a rudder member 12, a flap member 14, a rudder gear 16, a flap gear 18 and a gear cover 20. The flap rudder 10 is connected to a hull structure 22 of a ship aft of a propeller. Specifically, a rudder stock 24 of the rudder member 12 passes through a rudder port 26 of the hull structure 22 into an interior portion of the ship and joined to couplings and gearing controlled to cause movement of the rudder member 12. The rudder member 12 to hull 22 interface is sealed, such as with a split-ring seal 28, for example.

The rudder member 12 is rotatably mounted on the hull structure 20 by the rudder stock 24 such that the rudder member 12 is suspended from the hull structure 22. The flap member 14 is pivotally mounted on a trailing edge 30 of the rudder member 12 by way of a pivot rod 32.

The rudder gear 16 is connected to the hull structure 22, such as by welding it in place. The rudder gear 16 remains fixed in position when either or both of the rudder member 12 and the flap member 14 move. The flap gear 18 is connected to the flap member 14 and is arranged to move with movement of either or both of the rudder member 12 and the flap member 14. As shown in FIGS. 5-8, the flap member 14 and the flap gear 18 are separate components of the rudder 10. The flap member 14 includes a socket 34 and a retaining bushing 36 at its leading edge. The flap member 14 further includes a component that permits axial movement of the flap gear 18 with respect to the socket 34. For example, that member may be a spring 38. The flap gear 18 includes a gear section 40 and a rod section 42. The socket 34, the bushing 36 and the rod section 42 are configured so that the rod section 42 fits into the socket 34 and is removably retained therein by the bushing 36. When seated in position in the socket 34, the rod 42 is adjacent to and in contact with a wear plate 44 spaced between the rod 42 and the spring 38.

The rudder member 12 and the flap member 14 are joined together through the pivot rod 32, the location of which establishes the spacing between those members. The flap member 14 moves with respect to the rudder member 12 by actuation of the pivot rod 32 and that movement is regulated by engagement of teeth 46 of the flap gear 18 with teeth 48 of the rudder gear 16. While the rudder gear 16 remains in a fixed position, the flap gear 18 moves with movement of the flap member 14, as can be seen in a comparison of the location of the teeth 46 with respect to the location of the teeth 48 shown in FIGS. 2 and 3.

The flap member 14 and the flap gear 18 combination permits continued functioning of the rudder 10 under conditions when either or both of the rudder member 12 and the flap member 14 are bent, torqued, twisted or otherwise less than completely aligned. That continued functioning is enabled because the rod 42 can rotate within the socket 34 so that the teeth 46 of the flap gear 18 will remain aligned with the teeth of the rudder gear 16 when the rudder member 12 and the flap member 14 are misaligned. In addition, the flap member 14 and the flap gear 18 combination permits continued functioning of the rudder 10 under conditions when debris gets into the gears. That continued functioning is enabled in that situation because the spring 38 will take up axial displacement of the flap gear 18 within the socket 34 until the debris is either crushed or passes out of the space between teeth 46 and teeth 48. The rotational, compressive and elongate characteristics of the flap gear 18 maintain rudder 10 operation whether the rudder stock 24 bent sideways, fore or aft. The spring 38 has a spring value sufficient to keep the flap gear 18 in place when the rudder member 12 and the flap member 14 are properly aligned but will compress when needed. The compression in the spring 38 can be adjusted after the rudder 10 is in place to a value sufficient for the rudder 10 to operate as intended. Further, the inclusion of the spring 38 provides adjustability to correct misalignment of components of the rudder 10 including the rudder stock 24, the fixed rudder gear 16 and the movable flap gear 18. This is an advantage over existing flap rudders which must be built to relatively tighter tolerances to reduce the possibility of misalignment that may result in rudder limitations including failure.

Figure 9:
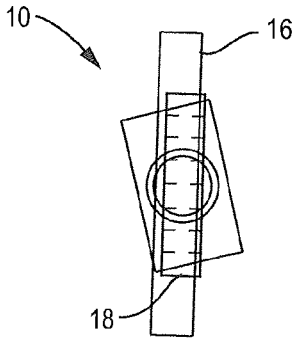
FIG. 9 is an end view of the rudder of the present invention shown bent while also showing that it is not jammed with respect to the flap.

The gear cover 20 is connected to the rudder gear 16 and to the hull structure 22. It is located over the interface between the teeth 46 of the flap gear 18 and the teeth 48 of the rudder gear 16. It is provided to minimize damage to the rudder 10 at that interface resulting from contact with debris or impact with a structure. As illustrated in FIG. 9, the rudder 10 remains operational with no jamming of the rudder gear 16 and the flap gear 18 even with a bent rudder member 12 that is shown in the figure as an example with the rudder member 12 about 15° out of alignment. Prior flap rudders would be incapacitated with such a bend of the rudder member.

The components of the rudder 10 of the present invention may be fabricated of one or more materials suitable for their intended functions in the environment of expected operation. For example, the rudder member 12, the flap member 14, the rudder gear 16 and the flap gear 18 may be fabricated of a metal such as steel, including stainless steel. The bushing 36 of the flap member 18 may be fabricated of metallic or non-metallic material. For example, the bushing 36 may be a bushing available from Thordon Bearings, Inc., of Burlington, Ontario, Canada.

It is to be understood that various modifications may be made to the rudder described herein without departing from the spirit and scope of the invention. Accordingly, other embodiments are within the scope of the claims appended hereto.

What is claimed is:

1. A rudder adapted to be mounted to the hull structure of a ship, the rudder comprising:

a. a rudder member including a rudder stock rotatably connectable to a hull structure of a ship;

b. a rudder gear connectable to the hull structure, the rudder gear including rudder teeth;

c. a flap member pivotally connected to the rudder member, wherein the flap member includes a socket and a compressible component in the socket; and d. a flap gear including:

i. a rod movably engaged and rotatable in the socket of the flap member; and ii. gear teeth for engagement with the rudder teeth of the rudder gear, wherein the compressible component permits axial movement of the rod in the socket to adjust alignment of the rudder gear and the flap gear, wherein the compressible component and the rod are arranged to maintain the gear teeth and the rudder teeth aligned when the rudder member and the flap member are misaligned, thereby enabling operation of the rudder when the rudder stock is bent sideways, fore or aft.

2. The rudder of claim 1 further comprising a gear cover connectable to the hull structure and the rudder gear to cover the rudder teeth and the gear teeth.

3. The rudder of claim 1 wherein the compressible component is a spring.

4. The rudder of claim 1 wherein the flap member is pivotally connected to a trailing edge of the rudder member.

5. A rudder adapted to be mounted to the hull structure of a ship, the rudder comprising:

a. a rudder member including a rudder stock rotatably connectable to a hull structure of a ship;

b. a rudder gear connectable to the hull structure, the rudder gear including rudder teeth;

c. a flap member pivotally connected to the rudder member, wherein the flap member includes a socket and a spring in the socket; and d. a flap gear including:

i. a rod movably engaged and rotatable in the socket of the flap member; and ii. gear teeth for engagement with the rudder teeth of the rudder gear, wherein the spring and the rod are arranged to maintain the gear teeth and the rudder teeth aligned when the rudder member and the flap member are misaligned, thereby enabling operation of the rudder when the rudder stock is bent sideways, fore or aft.

* * * * *